US005454143A

United States Patent [19]

Wigley

[11] Patent Number: 5,454,143

[45] **Date of Patent: * Oct. 3, 1995**

[54] DOORSTOP

[75] Inventor: Charles L. Wigley, Sr., Leeds, Ala.

[73] Assignee: Common-Sense Industries, Inc., Trussville, Ala.

[ * ] Notice: The portion of the term of this patent subsequent to Jan. 24, 2012 has been disclaimed.

[21] Appl. No.: 858,495

[22] Filed: Mar. 27, 1992

[51] Int. Cl.[6] ..... E05F 5/02

[52] U.S. Cl. ..... 16/82

[58] Field of Search ..... 16/82; 292/DIG. 15

[56] References Cited

U.S. PATENT DOCUMENTS

| | | | |
|---|---|---|---|
| 1,082,432 | 12/1913 | Mertsheimer | 292/DIG. 15 |
| 3,833,963 | 9/1974 | Waters | 292/DIG. 15 |
| 4,178,026 | 12/1979 | Sinkhorn | 292/DIG. 15 |
| 4,635,976 | 1/1987 | Sigler | 292/DIG. 15 |

FOREIGN PATENT DOCUMENTS

| | | | |
|---|---|---|---|
| 2620081 | 11/1977 | Germany . | |
| 2030639 | 4/1980 | United Kingdom | 292/DIG. 15 |

*Primary Examiner*—P. Austin Bradley
*Assistant Examiner*—Chuck Y. Mah
*Attorney, Agent, or Firm*—Veal & Marsh

[57] ABSTRACT

A doorstop including an elongated shaft slidably and rotatably received within a receptacle seated in a floor proximal a door. The shaft extends vertically from the receptacle and has a cross-member integrally connected thereto and extending therefrom in opposing lateral directions such that the door, when opened toward the shaft, will contact the cross-member and rotate the cross-member into planar contact with the door. Thus, the movement of the door will be limited by the shaft and laterally extending cross-member. A rigid plate may be connected to the door to protect the door from damage from the cross-member and shaft and, further, to distribute the force placed on the door over a larger surface area thereof.

10 Claims, 5 Drawing Sheets

FIG. 1
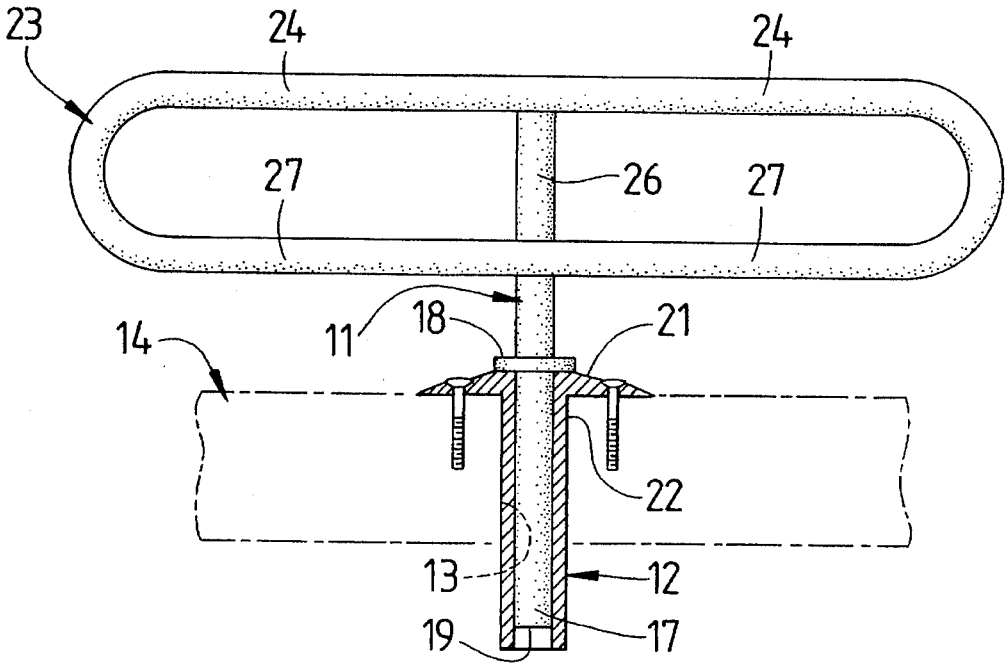
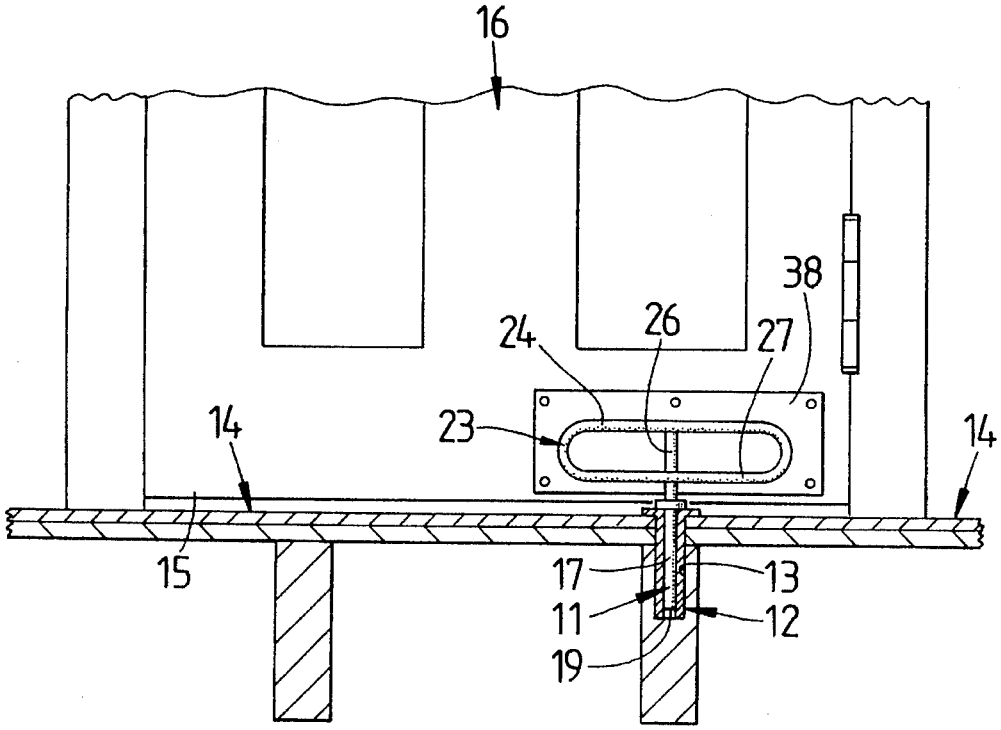
FIG. 2

FIG. 3
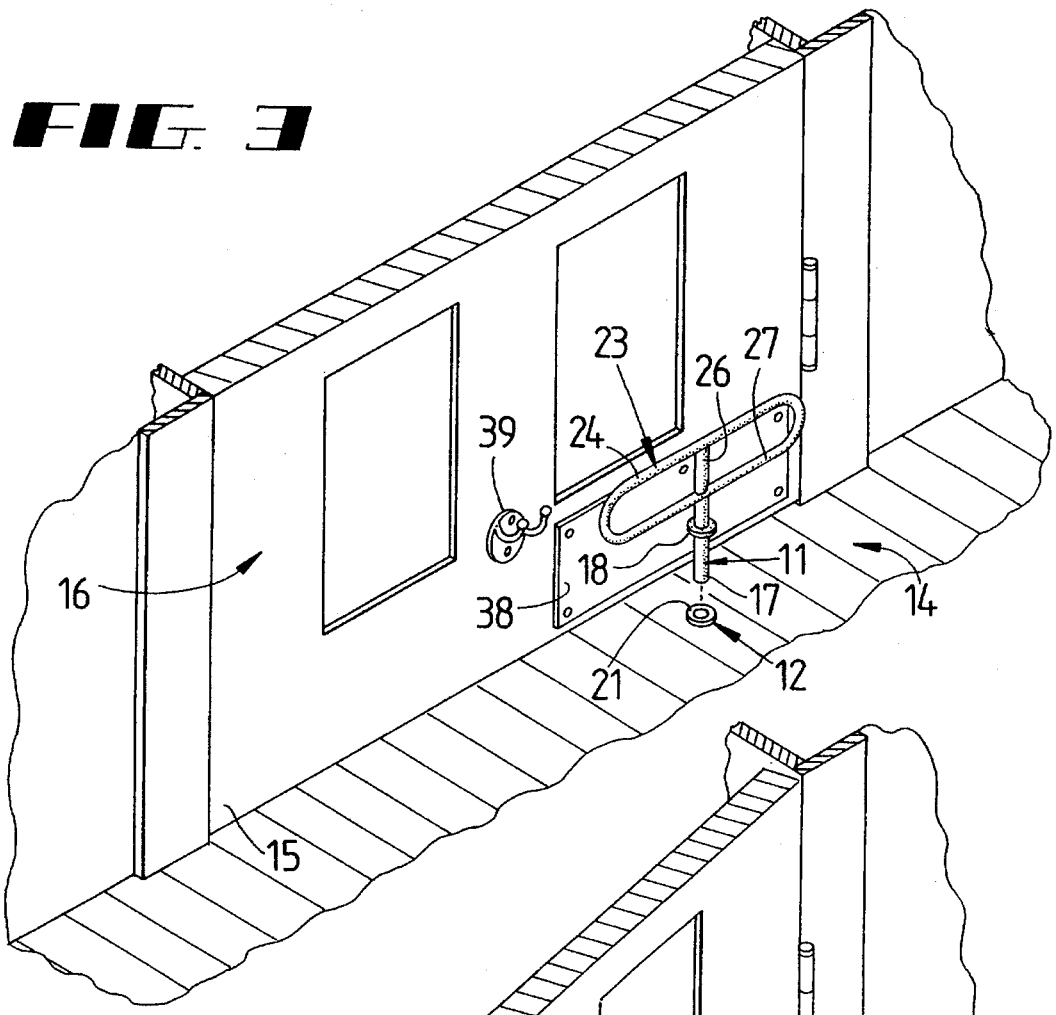
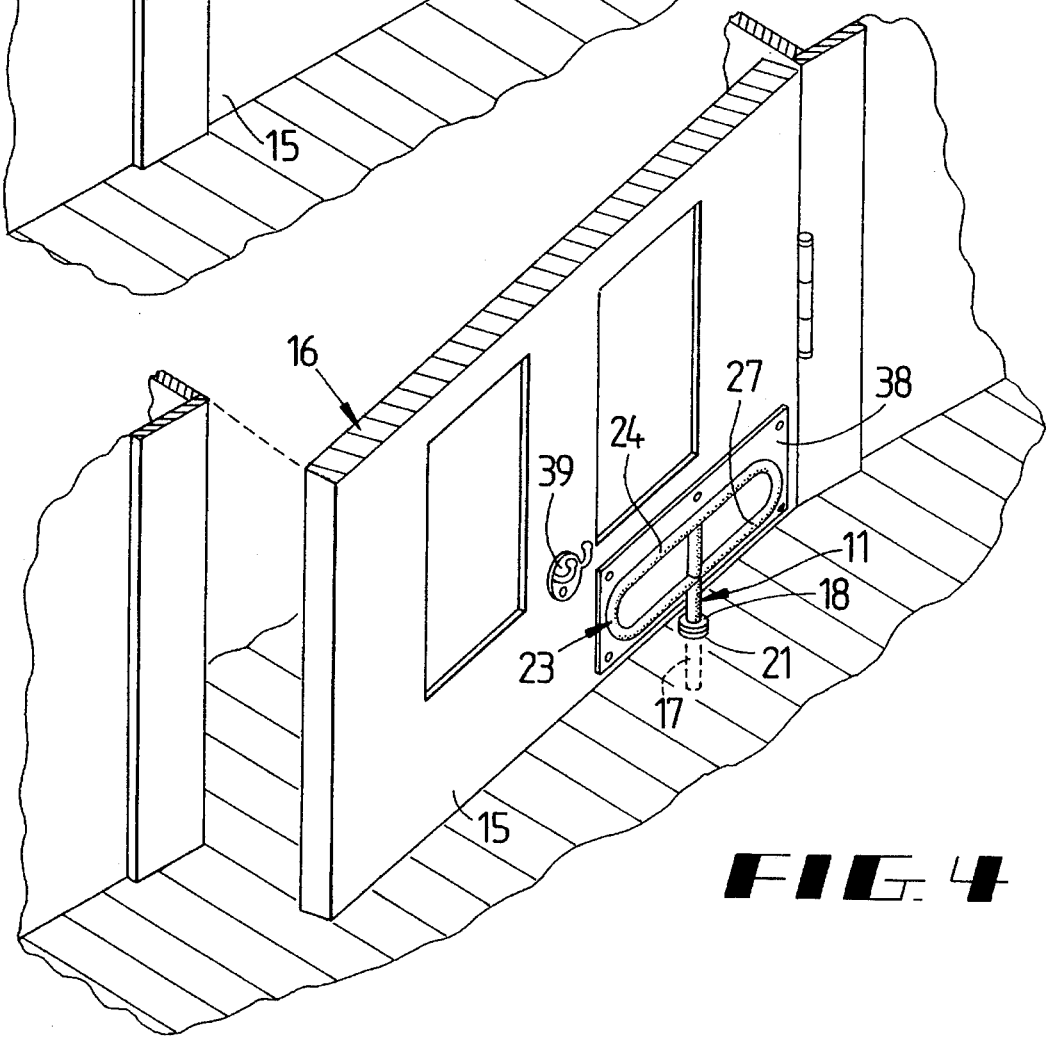
FIG. 4

DOORSTOP

FIELD OF THE INVENTION

The present invention relates to doorstops and more particularly to doorstops that permit some movement of a door from a closed position but obstruct the movement of the door at a predetermined distance from said closed position to prevent entry of a human body through a doorway. In even greater particularity the present invention relates to doorstops that are not connected to the door.

BACKGROUND OF THE INVENTION

Apparatus for locking a door in a closed position are numerous and varied in design and complexity. The shortcoming of most locking apparatus is that they only operate to secure the door when the door is in a closed position. If the door should be opened to view objects on the other side or to pass small objects through the doorway, most locking apparatus will not prevent the door from being forced completely open by an unwanted intruder.

Door chains connected to the door frame and selectively connected to the door provide a means for limiting the movement of a door from a closed position. However, most door chains are limited in the amount of force exerted on a door that the chain can withstand. The chain must be connected to the door itself, which provides a minimal structural base for securing the chain and further, the force exerted on the door by an intruder is concentrated at the connection of the chain with the door. Most chains are detachably engaged by brackets connected to the door by screws or other fasteners common to the industry. The force of an intruder is concentrated on the fasteners which usually have a minimal cross-sectional area and/or a minimal securing surface in contact with the door. Screws, bolts, nails and other securing apparatus tend to strip from the door when a large force (i.e. the mass of a human body in motion) is exerted against the door. Even if the securing apparatus were to hold, it is likely that the concentration of force on such a small area of the door will break the portion of door to which the chain is attached, thus permitting the door to open.

Another method of limiting the movement of the door from a closed position is the use of door braces which are pivotally secured at a lower end to the floor and extend in angular relation to and in abutment with the door. An upper end of the door brace is received within a vertically extending slot in the door such that movement of the door from the closed position will urge the upper end of the brace to the top of the slot whereby the brace will contact a stop and thus resist further movement of the door. The problem with door braces is twofold. One, the force exerted by an intruder is still concentrated at a very small area of the door and if the door is wooden, as many doors are, the door brace could be driven through the door. Secondly, the door brace assembly extends some distance from the door and within the adjacent room, thus presenting a visually distracting sight and possibly a hazardous obstacle to an inattentive person who may inadvertently trip over the door brace.

SUMMARY OF THE INVENTION

It is the principal object of the present invention to provide a doorstop that will arrest the movement of a door at a predetermined distance from a closed position.

In support of the principal object, another object of the present invention is to provide a doorstop that will distribute a resistive force against a maximum surface area of the door.

Yet another object of the present invention is to provide a doorstop having the aforesaid characteristics that is visually attractive and occupies a minimal amount of space.

These and other objects and advantages of the present invention are accomplished through the use of a shaft having a cylindrical lower portion that is slidably and rotatably received within a tubular receptacle seated within a hole in the floor proximal to the door. The shaft extends vertically from the receptacle to obstruct the movement of the door. A cross-member is integrally connected to the shaft and extends laterally therefrom within a vertical plane. When the door is opened toward the shaft, the door will contact the cross-member and rotate the cross-member in substantially planar contact with the door, thus providing a load bearing area across a maximum surface area of the door. A rigid plate may be connected to the door to protect the door and further distribute the load placed on the door across a greater width of the door. The tubular receptacle has a flange at an upper end thereof that supports the receptacle within the hole. The shaft has a flange thereon that supports the lower portion of the shaft within the receptacle. The shaft is removed from the receptacle when use of the doorstop is not required and stored by suspending the cross-member and shaft from a hook connected to the door.

BRIEF DESCRIPTION OF THE DRAWINGS

Apparatus embodying features of the present invention are depicted in the accompanying drawings which form a portion of this disclosure and wherein:

FIG. 1 is a side elevational view of the doorstop showing the receptacle in section and a floor in phantom lines;

FIG. 2 is a sectional view showing the present invention mounted adjacent a typical door;

FIG. 3 is a perspective view showing a door in closed position and the doorstop removed from its receptacle;

FIG. 4 is a perspective view showing a door partially opened and restrained by the doorstop;

DESCRIPTION OF A PREFERRED EMBODIMENT

Figure 5:
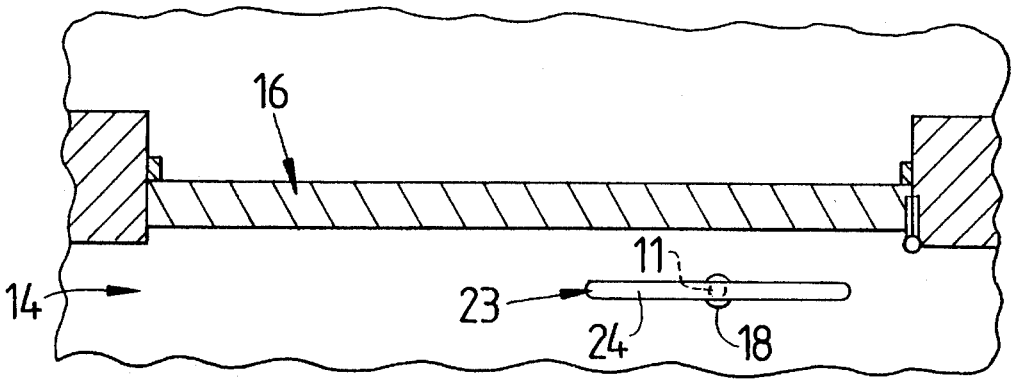
FIG. 5 is a sectional view taken along line 5—5 of FIG. 3.
Figure 6:
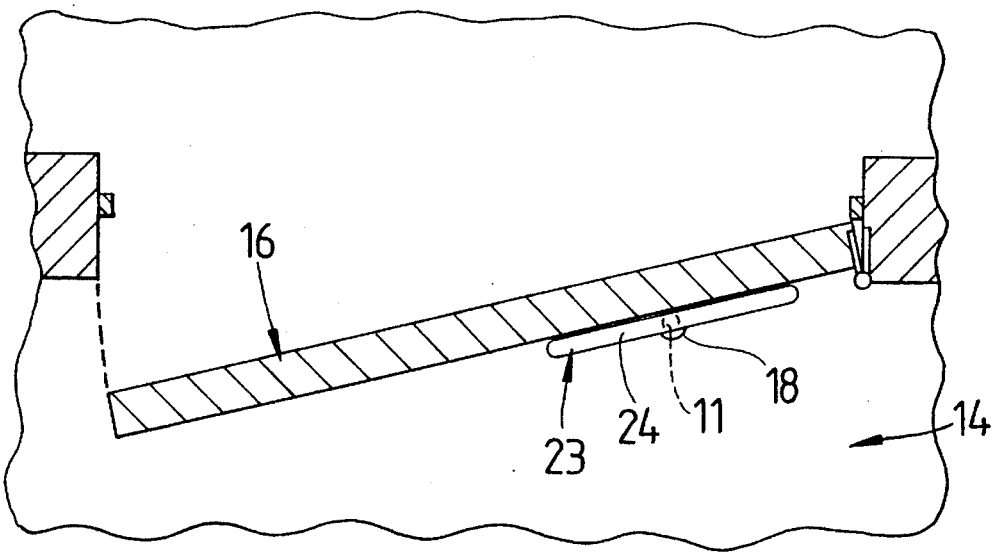
FIG. 6 is a sectional view taken along line 6—6 of FIG. 4.

Referring to the drawings for a clearer understanding of the invention, it should be noted in FIG. 1 that the present invention contemplates the use of a shaft 11 slidably and rotatably received within a tubular receptacle 12. The receptacle 12 is seated within a hole 13 formed in a floor 14 proximal to a lower edge 15 of a door 16. The shaft 11 includes a cylindrical lower portion 17 that is rotatably and slidably received within the tubular receptacle 12 and a flange 18 connected to the shaft 11 a predetermined distance from a lower end 19 thereof. The flange 18 extends outwardly from the shaft 11 and rests on a flange 21 integrally connected to an upper end 22 of the receptacle 12 and extending radially therefrom. Flange 21 rests on the floor 14 and thus may support receptacle 12 within the hole 13. The flange 18 supports the lower portion 17 of shaft 11 within receptacle 12. The shaft extends vertically above the receptacle 12 and has a cross-member 23 integrally connected thereto that extends from the shaft 11 in opposite lateral directions. In a first embodiment shown in FIGS. 1–6, the cross-member is depicted as an elongated horizontal oval which includes a first horizontal portion 24 integrally connected to the shaft 11 at an upper end 26 thereof. The first horizontal portion 24 curves downwardly and back toward the shaft 11 at a predetermined distance below upper end 26 forming a second horizontal portion 27 which is integrally connected to the shaft 11 and extends therefrom parallel to the first horizontal portion 24. The second horizontal portion 27 curves upwardly and toward the shaft 11 and is integrally connected to the first horizontal portion.

Figure 7:
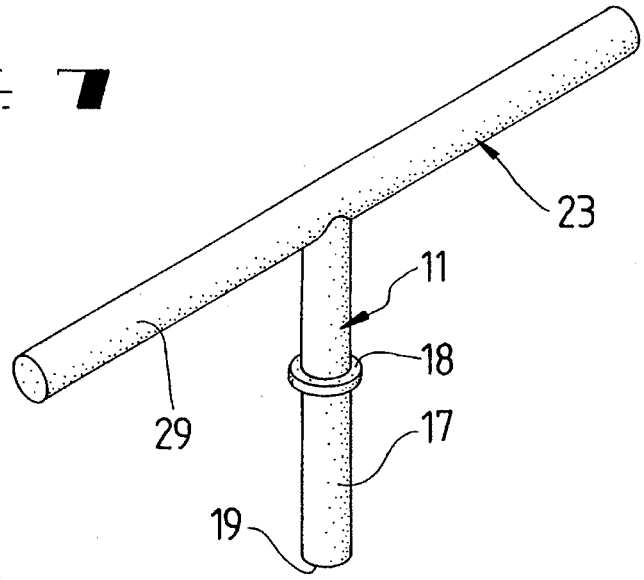
FIG. 7 is a perspective view of a second embodiment of the present invention.
Figure 8:
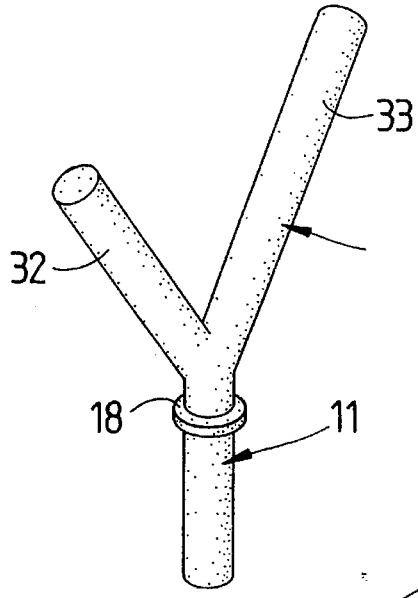
FIG. 8 is a perspective view of a third embodiment of the present invention.
Figure 9:
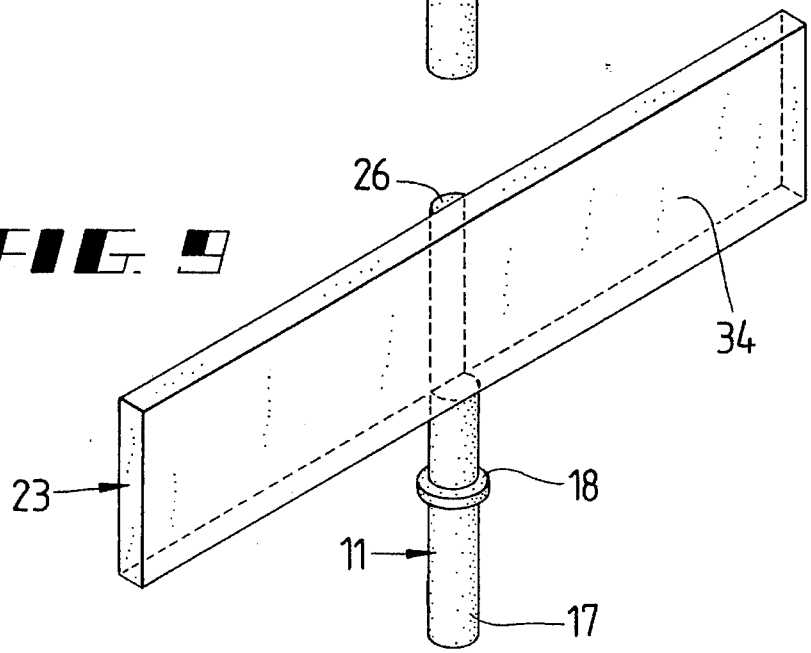
FIG. 9 is a perspective view of a fourth embodiment of the present invention.

Alternate embodiments of the present invention having various cross-member designs are shown in FIGS. 7–9. FIG. 7 shows a second embodiment wherein the cross-member 23 includes a laterally extending horizontal bar 29 that does not curve back toward the shaft 11. A third embodiment, shown in FIG. 8, includes shortened shaft 11 and two bar members 32 and 33 that extend upwardly and laterally from the upper end 26 of shaft 11 in a "V" or "Y" shape. A fourth embodiment, shown in FIG. 9, utilizes a plate-like member 34 integrally connected to shaft 11 and extending on opposing sides thereof. It is apparent that the present invention contemplates use of any of a variety of cross-member shapes that extend laterally from the shaft 11 on opposing sides thereof and defines a vertical contact surface 37 on opposing sides of shaft 11.

As shown in FIGS. 2–4, a rigid plate 38 such as a kick plate may be connected to the door 16 such that movement of the door 16 from a closed position will urge the rigid plate 38 in contact with the cross-member 23 and shaft 11. The rigid plate 38 protects the door from being damaged by contact with the cross-member 23 and shaft 11 and distributes a force exerted by a potential intruder over the enlarged surface area of the plate 38 and the surface of the door 16 in contact therewith.

In operation, the shaft 11 is inserted within the receptacle 12 when the door 16 is in a closed position. The door may then be partially opened whereby the door 16 will contact an end of the cross-member 23 and rotate the cross-member 23 in substantially planar contact with the opening door 16. The movement of the door 16 is halted as the door 16 is urged in planar contact with the cross-member 23 with the force exerted against the door 16 being distributed over a relatively large surface area thereof. Note that the receptacle 12 is constructed of any rigid material such as iron, steel, or brass and is particularly effective in supporting the shaft 11 in a vertical position especially when the floor 14 is constructed of a pliable material such as wood. It is recommended that the receptacle be inserted into the floor joist as shown in FIG. 2 for added security. If the floor 14 is constructed of concrete, steel or other more rigid materials, the receptacle may be eliminated and the shaft 11 inserted directly within hole 13 with flange 18 resting on the floor 14. Even when the floor 14 is constructed of a rigid material such as concrete, the use of a receptacle 12 will prevent the shaft 11 from wearing the interior of the hole 13 and thus prevent unnecessary movement of the shaft from its normal vertical extension. Note that the receptacle should be spaced from the door jamb, such that the door cannot be opened sufficiently to permit a person to squeeze through and should be located close enough to the door hinge to prevent an intruder from reaching around the door to dislodge the doorstop.

Figure 10:
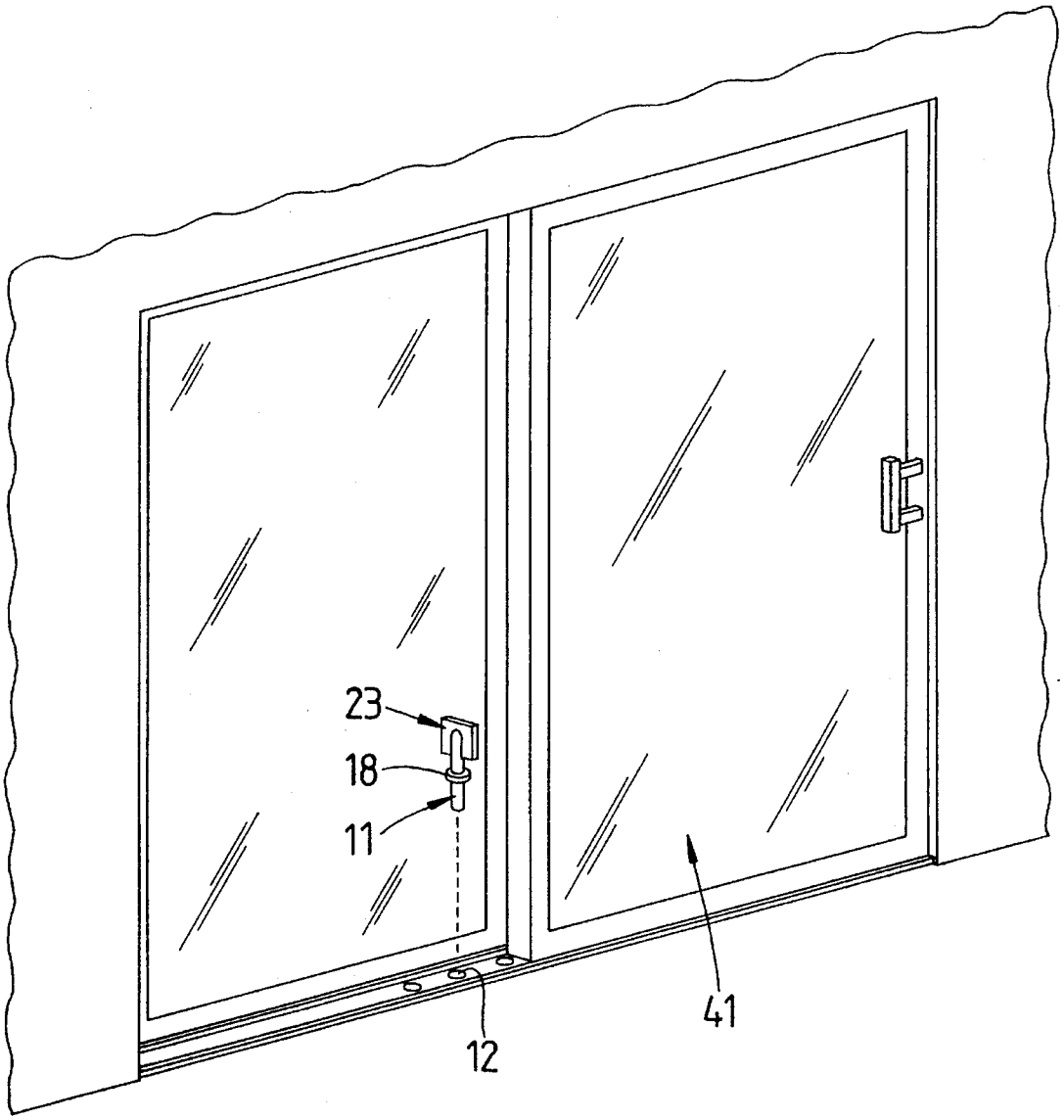
FIG. 10 is a perspective view showing the present invention adapted for use with a sliding door.

When not in use, the cross-member 23 and shaft 11 may be suspended from a hook 39 or other securing apparatus conveniently connected to the door 16. As shown in FIG. 10, the use of the present invention is not limited to pivotal doors 16 but may also be used to limit the movement of sliding doors 41 from a closed position. From the foregoing, it should be clear that the present apparatus represents a substantial improvement over the prior art.

While I have shown my invention in several forms, it will be obvious to those skilled in the art that it is not so limited but is susceptible of various changes and modifications without departing from the spirit thereof.

What I claim is:

1. A doorstop for limiting the movement of a door from a closed position, comprising a vertically extended shaft having a cylindrical lower portion slidably and rotatably received within a hole formed in a floor and spaced a predetermined distance from a bottom edge of said door when in said closed position and a cross-member rigidly connected to said cylindrical shaft above said lower portion and extending laterally from said shaft in opposite directions, wherein movement of said door from said closed position will move said door in contact with said cross-member and pivot said cross-member about a vertical axis such that said door is arrested by substantially planar contact with said cross-member and said shaft.

2. A doorstop as defined in claim 1 further comprising a shaft flange integrally connected to said shaft a predetermined distance from a lower end thereof, wherein said shaft flange extends radially from said shaft and rests on said floor to support said shaft within said hole.

3. A doorstop as defined in claim 1 further comprising a tubular receptacle snugly received within said hole, wherein said cylindrical lower portion of said shaft is slidably and rotatably received within said tubular receptacle.

4. A doorstop as defined in claim 3 further comprising a receptacle flange integrally connected to an upper end of said receptacle and extending radially therefrom to rest on said floor and support said receptacle within said hole.

5. A doorstop as defined in claim 4 further comprising a shaft flange integrally connected to said shaft a predetermined distance from a lower end thereof, wherein said shaft flange extends radially from said shaft and rests on said receptacle flange to support said lower portion within said receptacle.

6. A doorstop as defined in claim 4 further comprising means to affix said receptacle flange to said floor to secure said receptacle in said hole.

7. A doorstop as defined in claim 1 wherein said cross-member comprises:

(a) a first horizontal portion integrally connected to said shaft at an upper end thereof and extending horizontally therefrom; and (b) a second horizontal portion integrally connected to said shaft at a predetermined distance below said upper end thereof and extending horizontally therefrom in parallel relation to said first horizontal portion, wherein said first horizontal portion curves downwardly and toward said shaft and is integrally connected to said second horizontal portion to form an elongated horizontal oval.

8. A doorstop as defined in claim 1 wherein said cross-member comprises a plate-like member integrally connected to said shaft and extending laterally from said shaft.

9. A doorstop as defined in claim 1 further comprising a rigid plate connected to said door adjacent a lower edge thereof and proximal said shaft, such that movement of said door will urge said plate against said cross-member and said shaft, wherein a force exerted against said door will be distributed to said plate and across a surface area of said door adjacent thereto.

10. A doorstop as defined in claim 1 wherein said hole is formed in said floor adjacent said bottom edge and proximal a hinge supporting said door such that said cross-member abuts said door between said hinge and a vertical mid-line of said door.

* * * * *